US010044174B2

(12) United States Patent
Hariya et al.

(10) Patent No.: US 10,044,174 B2
(45) Date of Patent: Aug. 7, 2018

(54) IONIZER WITH ELECTRODE UNIT IN FIRST HOUSING SEPARATED FROM POWER SUPPLY CONTROLLER

(71) Applicant: SMC CORPORATION, Chiyoda-ku (JP)

(72) Inventors: Tomokazu Hariya, Noda (JP); Takayuki Toshida, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 229 days.

(21) Appl. No.: 15/013,198

(22) Filed: Feb. 2, 2016

(65) Prior Publication Data

US 2016/0249441 A1 Aug. 25, 2016

(30) Foreign Application Priority Data

Feb. 20, 2015 (JP) ..... 2015-032098

(51) Int. Cl.
*H05F 3/06* (2006.01)
*H01T 23/00* (2006.01)
*H01T 19/04* (2006.01)

(52) U.S. Cl.
CPC ..... *H01T 23/00* (2013.01); *H01T 19/04* (2013.01)

(58) Field of Classification Search
CPC ..... H01T 23/00; H01T 19/04; H01T 19/00; H05F 3/06; H05F 3/04; H05F 1/00; H05F 3/00; H05F 3/02; H05F 3/60; B03C 3/38; B03C 3/68; B03C 2201/10; B03C 2201/32; B03C 3/011; B03C 3/36; B03C 3/383; B03C 3/41; B03C 2201/06; B03C 2201/24; B03C 3/025; B03C 3/32; B03C 3/368; H02K 11/40; H01J 27/022; H01J 27/08; H01J 37/32082; H01J 37/32348; H01J 37/3277; H01J 37/32935; H01J 2235/166; H01J 2235/168; H01J 2235/186; H01J 2237/0206; H01J 2237/0812; H01J 27/026; H01J 35/16; H01J 35/18; H01J 37/08; H01J 37/241; H01J 37/302; H01J 37/3056;
(Continued)

(56) References Cited

U.S. PATENT DOCUMENTS 4,216,518 A * 8/1980 Simons ..... H01T 19/04 361/213
5,930,105 A * 7/1999 Pitel ..... H05F 3/04 361/212

(Continued)

FOREIGN PATENT DOCUMENTS

JP 2001133508 * 5/2001
JP 2011-9167 1/2011

(Continued)

*Primary Examiner* — Thienvu Tran
*Assistant Examiner* — Nicolas Bellido
(74) *Attorney, Agent, or Firm* — Oblon, McClelland, Maier & Neustadt, L.L.P.

(57) ABSTRACT

An electrode unit formed by mounting a discharge electrode in a first housing, and a power supply control unit formed by locating a high voltage generation circuit that outputs a pulsating high voltage to the electrode unit in a second housing are electrically connected via a shielded cable, and a capacitor is connected to a ground line electrically connecting between a shield layer of the shielded cable and the ground.

5 Claims, 4 Drawing Sheets

(58) Field of Classification Search
CPC ..... H01J 37/3171; H05H 1/2406; H05H 2001/2468; H05H 2001/2412; Y10T 307/839; Y10T 29/49826; Y10T 307/74; B01D 2259/818; B01D 53/32; B01D 2258/06
See application file for complete search history.

(56) References Cited

U.S. PATENT DOCUMENTS 7,120,006 B2 * 10/2006 Sekoguchi ..... A61L 9/22 361/230
7,180,722 B2 * 2/2007 Jacobs ..... H01T 23/00 361/230
7,973,292 B2 * 7/2011 Tsumori ..... H01T 23/00 250/423 F
8,963,015 B2 * 2/2015 Wittkop ..... H01G 4/35 174/260
2011/0054572 A1 * 3/2011 Jeffrey ..... A61H 33/005 607/85
2012/0197130 A1 * 8/2012 Amemiya ..... G01S 7/52025 600/459
2014/0104891 A1 * 4/2014 Kim ..... H02M 3/33569 363/20
2015/0109714 A1 * 4/2015 Toshida ..... H01T 23/00 361/213
2015/0124368 A1 * 5/2015 Toshida ..... H01T 19/04 361/231
2015/0366111 A1 * 12/2015 Yagi ..... H02M 1/44 174/350

FOREIGN PATENT DOCUMENTS

JP 2011-9168 1/2011
JP 2011-14319 1/2011
JP 2012-252800 12/2012

* cited by examiner

IONIZER WITH ELECTRODE UNIT IN FIRST HOUSING SEPARATED FROM POWER SUPPLY CONTROLLER

TECHNICAL FIELD

The present invention relates to an ionizer that alternately applies a positive and negative high voltage to a discharge electrode such as a discharge needle so as to generate ions of positive and negative polarities, thereby electrically neutralizing a charged work.

BACKGROUND ART

Ionizers are already known that alternately apply a positive and negative high voltage to a discharge electrode such as a discharge needle so as to generate ions of positive and negative polarities, thereby electrically neutralizing a charged work. The ionizer of this type generally includes, as disclosed in Patent Literature (PTL) 1, the discharge electrode and a power supply controller including a high voltage generation circuit that outputs the positive and negative high voltage to the discharge electrode, the discharge electrode and the power supply controller being integrally incorporated in a housing. Such a configuration inevitably leads to an increase in outer dimensions of the housing, and may thereby disable the ionizer from being installed at a desired location when the space availability of the intended location is limited.

To cope with such a drawback, for example PTL 2 discloses an ionizer in which an electrode unit is formed by locating the discharge electrode a different housing from the power supply controller, and the housing of the discharge electrode is formed in a smaller size, so that the discharge electrode can be installed separately from the power supply controller. In this case, a shielded cable may be employed for the electrical connection between the power supply controller and the electrode unit, and the cable generally includes an insulating layer interposed between the conductor and the shield layer.

Here, the amount of ion generated from the discharge electrode in the ionizer is proportional to an integral value of the voltage waveform actually applied to the electrode, and therefore, for example when the power supply controller outputs a pulsating voltage, it is preferable that the voltage is applied to the discharge electrode with the pulse waveform maintained to a maximum possible extent.

However, in the mentioned shielded cable a kind of capacitor (so called virtual capacitor) is formed between the conductor and the shield layer, and hence an electrostatic capacitance, acting as a floating capacitance (parasitic capacitance), is generated in the shielded cable itself. Accordingly, even though a voltage of such a pulse waveform as represented by solid lines in FIG. 7 is outputted from the power supply controller, the voltage waveform actually inputted in the electrode unit (i.e., applied to the discharge electrode) is deformed as shown in FIG. 8 owing to a response delay originating from the electrostatic capacitance, and consequently the ion generation efficiency is degraded. Such an impact of the floating electrostatic capacitance in the cable on the ion generation efficiency is pointed out also in PTL 3 and PTL 4.

[PTL 1] Japanese Unexamined Patent Application Publication No. 2011-014319

[PTL 2] Japanese Unexamined Patent Application Publication No. 2012-252800

[PTL 3] Japanese Unexamined Patent Application Publication No. 2011-009167

[PTL 4] Japanese Unexamined Patent Application Publication No. 2011-009168

SUMMARY OF INVENTION

Accordingly, the present invention aims at suppressing degradation in ion generation efficiency in an ionizer including an electrode unit composed of discharge electrodes such as discharge needles enclosed in a housing, and a power supply controller that outputs a pulsating high voltage to the electrode unit, the electrode unit and the power supply controller being electrically connected to each other via a shielded cable so as to be installed separately from each other, by suppressing deformation of a voltage waveform originating from floating electrostatic capacitance in the shielded cable.

In an aspect, the present invention provides an ionizer that includes an electrode unit including a discharge electrode, a power supply controller that outputs a pulsating high voltage to the electrode unit, and a cable that electrically connects the electrode unit and the power supply controller, the electrode unit being formed by mounting the discharge electrode in a first housing separated from the power supply controller so as to be installed with a spacing from the power supply controller. The cable is a shielded cable including an electric wire formed of a conductor, an insulating layer formed of an insulating material surrounding the electric wire, and a shield layer formed of a conductor surrounding the insulating layer, and a capacitor is connected between the shield layer and ground.

In the ionizer configured as above, the electrostatic capacitance of the cable as a whole, inclusive of the capacitor, is suppressed to a level below the electrostatic capacitance of the cable alone, generated between the electric wire and the shield layer (floating electrostatic capacitance of the cable). Therefore, deformation of the waveform of the pulse voltage applied to the discharge electrode through the cable is suppressed compared with the case where the capacitor is not provided, and degradation in ion generation efficiency can be suppressed.

It is preferable that the capacitor has electrostatic capacitance smaller than the electrostatic capacitance between the electric wire and the shield layer in the cable (floating electrostatic capacitance of the cable), because in this case the electrostatic capacitance of the cable as a whole inclusive of the capacitor can be reduced to less than a half of the floating electrostatic capacitance of the cable.

In the ionizer configured as above, the power supply controller may alternately output a positive and negative pulsating high voltage successively.

Preferably, the power supply controller may include a high voltage generation circuit that boosts an oscillating voltage from an oscillation power source thereby converting into a positive and negative DC voltage, and alternately switches the positive and negative DC voltage successively to output the DC voltage to the electrode unit. More preferably, the electrode unit may include a first discharge electrode and a second discharge electrode, and the high voltage generation circuit alternately and successively switches between a voltage of a first polarity pattern in which the positive DC voltage is applied to the first discharge electrode and the negative DC voltage is applied to the second discharge electrode, and a voltage of a second polarity pattern in which the negative DC voltage is applied to the first discharge electrode and the positive DC voltage is applied to the second discharge electrode, to output the DC voltage to the electrode unit.

In the ionizer configured as above, the capacitor may be located in the cable, or the high voltage generation circuit may be located in a second housing and the capacitor may be located in the second housing.

In the ionizer configured as above may further include a discharge resistance for discharging the electric charge on the shield layer to the ground, connected in parallel to the capacitor.

In the ionizer configured as above, as described above, the capacitor is connected between the shield layer of the shielded cable and the ground, in the ionizer in which the power supply controller that outputs the pulsating high voltage and the electrode unit including the discharge electrodes enclosed in the first housing separated from the power supply controller are electrically connected to each other via the shielded cable. Accordingly, a kind of capacitor formed between the electric wire and the shield layer of the cable (virtual capacitor) and the capacitor are connected in series, and the electrostatic capacitance of the cable as a whole inclusive of the capacitor can be suppressed to a level smaller than the electrostatic capacitance of the cable alone (floating electrostatic capacitance of the shielded cable). Therefore, deformation of the voltage waveform applied to the discharge electrode through the cable is suppressed compared with the case where the capacitor is not provided, and degradation in ion generation efficiency can be suppressed.

DESCRIPTION OF EMBODIMENTS

Hereafter, a first embodiment of the ionizer according to the present invention will be described in details, with reference to FIG. 1 to FIG. 5.

The present invention is useful to such ionizers that apply a pulsating high voltage to a discharge electrode such as a discharge needle, and in particular, among such ionizers, to an ionizer based on AC wave that alternately applies positive and negative DC high voltage (i.e., positive and negative pulsating high voltage) successively to one or a plurality of discharge electrodes, thereby alternately generating ion of positive and negative polarities from each of the discharge electrode.

Hereunder, therefore, the ionizer based on AC wave will be taken up as example for the description.

The ionizer 1 includes an electrode unit 2 including discharge electrodes 2*a* and 2*b* that generate ion by corona discharge, and a power supply controller 3 that alternately switches a positive and negative DC high voltage successively at predetermined time intervals (half of a period T shown in FIG. 7) and outputs the DC high voltage to the electrode unit 2, to thereby apply such DC high voltage to the discharge electrodes 2*a* and 2*b*. Accordingly, the discharge electrodes 2*a* and 2*b* each emit ion of the polarity of the applied voltage (positive ion when the positive voltage is applied, negative ion when the negative voltage is applied), so as to electrically neutralize a charged object to be destaticized, with the emitted ion.

Figure 1:
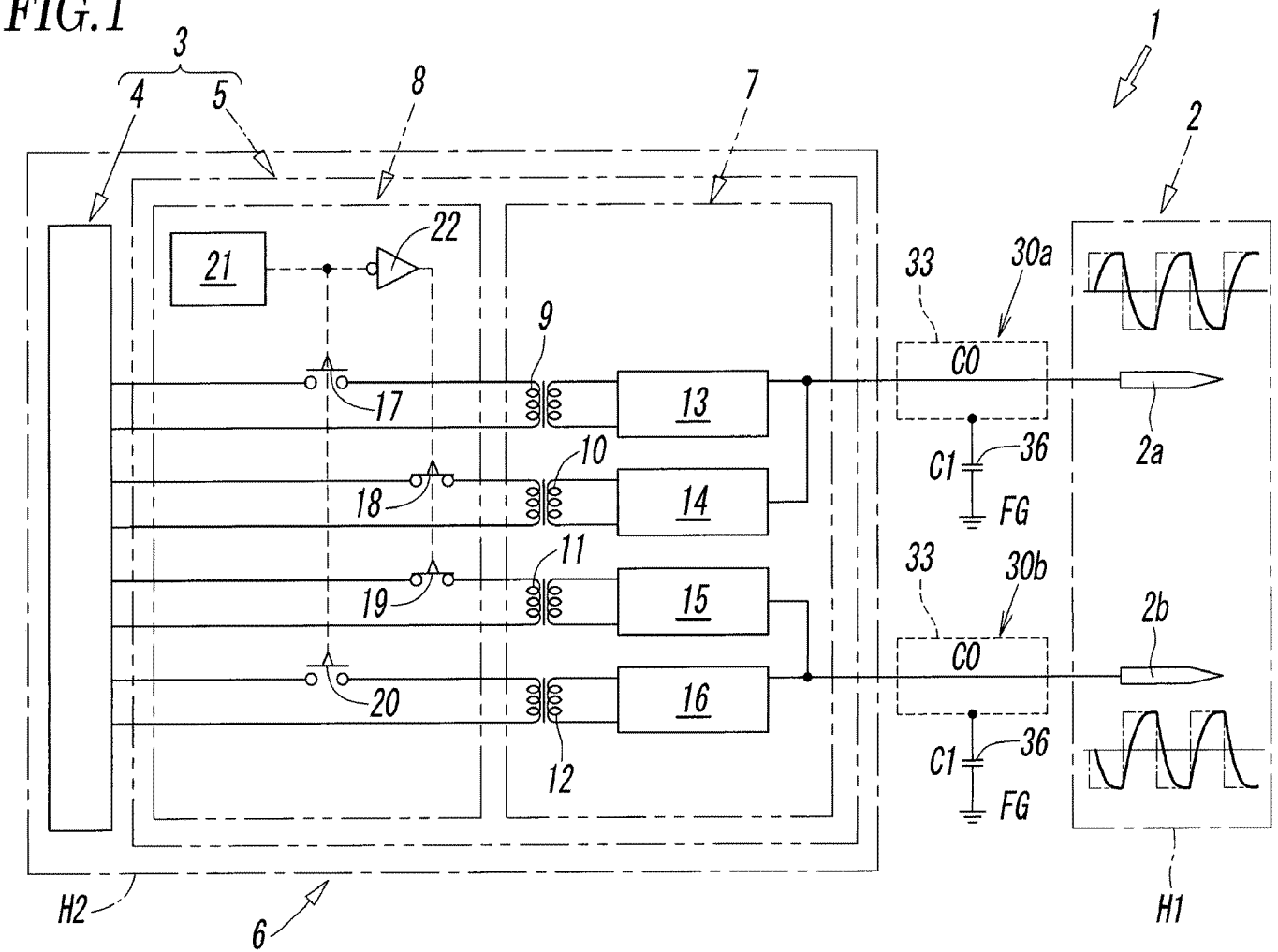
FIG. 1 is a schematic block diagram showing a general configuration of an ionizer according to a first embodiment of the present invention.

In this embodiment, the discharge electrode includes, as shown in FIG. 1, the first discharge electrode 2*a* and the second discharge electrode 2*b* that simultaneously generate ion of different polarities. The electrode unit 2 is constituted by mounting the first discharge electrode 2*a* and the second discharge electrode 2*b* in a single first housing H1 (more precisely, accommodated inside the first housing H1 and fixed thereto).

In this embodiment, in addition, the power supply controller 3 includes an oscillation power source 4 that outputs an oscillating voltage of a predetermined frequency (for example, 50 KHz), and a high voltage generation circuit 5 that boosts the oscillating voltage to convert into a positive and negative DC high voltage and alternately switches the positive and negative DC high voltage successively at the predetermined time interval (T/2), to output the DC high voltage. The power source 4 and the high voltage generation circuit 5 of the power supply controller 3 are accommodated in a single second housing H2 formed separately from the first housing H1, and constitute a power supply control unit 6.

The power supply control unit 6 (more precisely, the high voltage generation circuit 5 of the power supply controller 3) and the electrode unit 2 are electrically connected to each other via cables 30*a* and 30*b* for transmitting the DC high voltage from the high voltage generation circuit 5 to the electrode unit 2 to thereby apply the DC high voltage to the discharge electrodes 2*a* and 2*b*, and can be installed at separate locations. In other words, the electrode unit 2 including the discharge electrodes 2*a* and 2*b* directly involved with generation and emission of ion and the power supply control unit 6 including the power source 4 and the high voltage generation circuit 5 which are not directly involved with the generation and emission of ion can be installed at separate locations.

Therefore, the first housing H1 can be formed in a reduced size so as to make the electrode unit 2 smaller in size, which enables the electrode unit 2 to be installed close to an object to be destaticized and the power supply control unit 6 to be installed at a separate location, when the entirety of the ionizer 1 is unable to be installed close to the object to be destaticized owing to spatial restriction.

To be more detailed, the high voltage generation circuit 5 of the power supply control unit 6 (power supply controller 3) includes a boost rectifier circuit 7 that boosts and rectifies the oscillating voltage from the power source 4 to convert into the positive and negative DC high voltage, and a polarity control circuit 8 that alternately and successively switches the polarity of the DC high voltage outputted to the electrode unit 2 through the cables 30*a* and 30*b*, at the predetermined time interval (T/2).

In this embodiment, the cable is composed of the first cable 30*a* connected to the first discharge electrode 2*a* for supplying the voltage, and the second cable 30*b* connected to the second discharge electrode 2*b* to supply the voltage. Therefore, the polarity control circuit 8 can control the boost rectifier circuit 7 so as to simultaneously output a voltage of different polarities through the first and second cables 30*a* and 30*b*, and alternately switch the polarity successively at the predetermined time interval (T/2).

Thus, in this embodiment the power supply control unit 6 is configured to alternately and successively switch, at the predetermined time interval (T/2), between a voltage of a first polarity pattern in which the positive DC high voltage is applied to the first discharge electrode 2*a* and the negative DC high voltage is applied to the second discharge electrode 2*b* at the same time, and a voltage of a second polarity pattern in which the negative DC high voltage is applied to the first discharge electrode 2*a* and the positive DC high voltage is applied to the second discharge electrode 2*b* at the same time, when outputting the DC high voltage to the electrode unit 2 through the first and second cables 30*a* and 30*b*.

Here, the boost rectifier circuit 7 includes, as shown in FIG. 1, a first step-up transformer 9 and a second step-up transformer 10 that boost the oscillating voltage outputted from the power source 4, and a third step-up transformer 11 and a fourth step-up transformer 12 that also boost the oscillating voltage outputted from the power source 4. The boost rectifier circuit 7 also includes a first and a second positive electrode circuit 13 and 15 that convert the oscillating voltage boosted by the first and third step-up transformers 9 and 11 into the DC high voltage of positive polarity, and a first and a second negative electrode circuit 14 and 16 that convert the oscillating voltage boosted by the second and fourth step-up transformers 10 and 12 into the DC high voltage of negative polarity. The first positive electrode circuit 13 and the first negative electrode circuit 14 are connected to the first cable 30*a*, and the second positive electrode circuit 15 and the second negative electrode circuit 16 are connected to the second cable 30*b*.

The polarity control circuit 8 includes a first and a third switch 17 and 19 that individually turn on and off the electrical connection between the power source 4 and the first and second positive electrode circuits 13 and 15 respectively, and a second and a fourth switch 18 and 20 that individually turn on and off the electrical connection between the power source 4 and the first and second negative electrode circuits 14 and 16 respectively. Further, the polarity control circuit 8 includes a command circuit 21 that outputs a command signal (on/off signal) for turning on and off the first to the fourth switches 17 to 20. Here, a logic inverting circuit 22 that inverts the command signal from the command circuit 21 is connected between the command circuit 21 and the second and third switches 18 and 19, by which the command signal from the command circuit 21 is directly inputted as it is to the first and fourth switches 17 and 20, while the inverted command signal is inputted to the second and third switches 18 and 19.

Accordingly, when the command circuit 21 outputs an ON command signal, the first and fourth switches 17 and 20 are closed and the second and third switches 18 and 19 are opened. Therefore, the positive DC high voltage from the first positive electrode circuit 13 is applied to the first discharge electrode 2*a* through the first cable 30*a*, and the negative DC high voltage from the second negative electrode circuit 16 is applied to the second discharge electrode 2*b* through the second cable 30*b* (first polarity pattern).

Conversely, when the command circuit 21 outputs an OFF command signal, the second and third switches 18 and 19 are closed and the first and fourth switches 17 and 20 are opened. Accordingly, the negative DC high voltage from the first negative electrode circuit 14 is applied to the first discharge electrode 2*a* through the first cable 30*a*, and the positive DC high voltage from the second positive electrode circuit 15 is applied to the second discharge electrode 2*b* through the second cable 30*b* (second polarity pattern).

Figure 7:
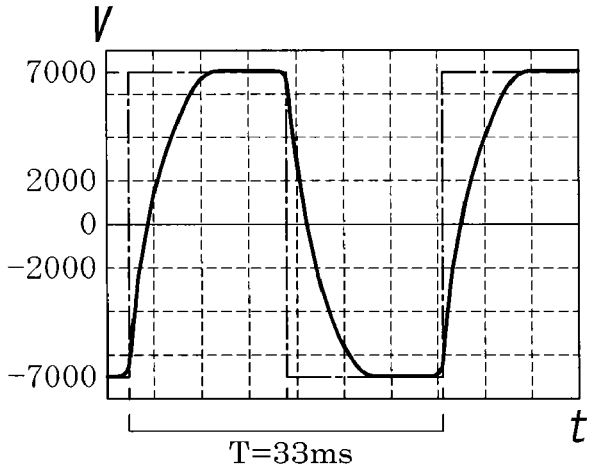
FIG. 7 is a graph showing a voltage waveform outputted from a high voltage generation circuit, in which dash-dot lines represent a theoretical waveform and solid lines represent an actual waveform.

Thus, by switching the command signal outputted from the command circuit 21 at the predetermined time interval (T/2), the power supply control unit 6 alternately and successively outputs, theoretically, the positive and negative DC high voltage as illustrated in dash-dot lines in FIG. 7 (positive and negative rectangular pulsating voltage). Since the voltage outputted through the first and second cables 30*a* and 30*b* has the reverse polarity from each other in this embodiment, the voltage is alternately switched between the first polarity pattern and the second polarity pattern successively, at the predetermined time interval (T/2), to be outputted to the electrode unit 2. In other words, an AC voltage of a positive and negative continuous rectangular pulse wave formed over the period T and having a phase difference of 180 degrees is outputted from the power supply control unit 6 through the first and second cables 30*a* and 30*b*. However, the voltage waveform actually outputted from the power supply control unit 6 assumes an AC waveform of a positive and negative continuous pulse wave formed over the period T as illustrated in solid lines in FIG. 7, owing to a response delay in the power supply control unit 6.

In this embodiment, the first and second cables 30*a* and 30*b* have the same length and the same structure as described below. Accordingly, the voltages applied by the power supply control unit 6 to the first and second discharge electrodes 2*a* and 2*b* through the first and second cables 30*a* and 30*b* are only different in polarity (have a phase difference of 180 degrees), and other characteristics such as the amplitude and period T are the same. Therefore, although the description thus far given with reference to FIG. 7, as well as the description to be subsequently given with reference to FIG. 3 and FIG. 8 refers to a single voltage waveform for the sake of clarity, both of the mentioned voltages are referred to.

Figure 2:
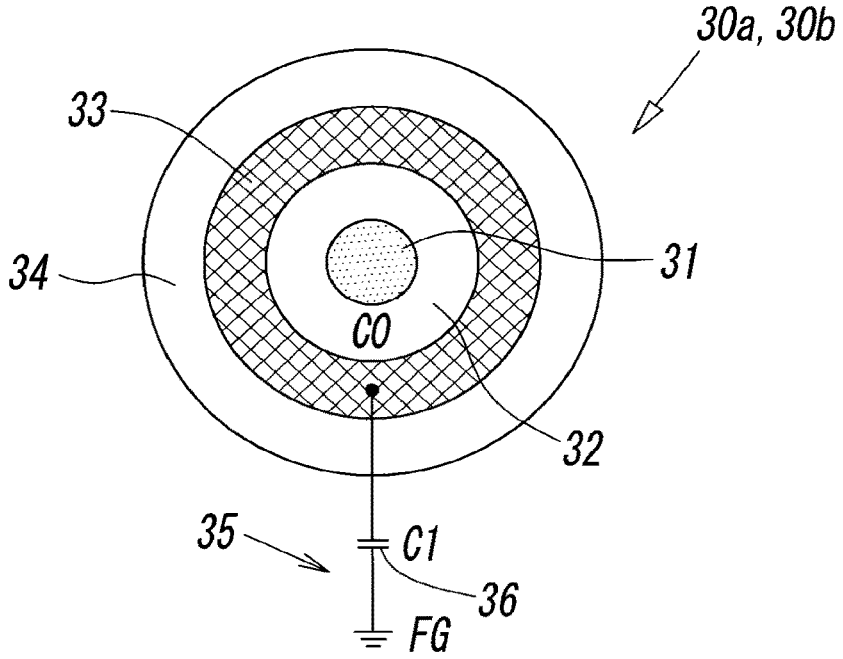
FIG. 2 is a schematic cross-sectional view of a shielded cable included in FIG. 1.

Each of the first and second cables 30*a* and 30*b* includes, as shown in FIG. 2, an electric wire 31 formed of a conductor for transmitting the pulsating high voltage outputted from the power supply control unit 6 to the electrode unit 2, an insulating layer 32 formed of an insulating material and covering the outer circumferential surface of the electric wire 31, a shield layer 33 formed of a conductor and covering the outer circumferential surface of the insulating layer 32, and a sheath layer 34 formed of an insulating material and covering the outer circumferential surface of the shield layer 33. Thus, the insulating layer 32, the shield layer 33, and the sheath layer 34 are sequentially formed coaxially about the electric wire 31.

The electric wire 31 may be a stranded wire, without limitation to the solid wire as shown in FIG. 2. The insulating layer 32, which electrically insulates the electric wire 31, may be formed of a synthetic resin such as silicone resin, fluorine resin (FEP or the like), or cross-linked polyethylene. The shield layer 33 is formed of, for example, a conductor foil, tape, or braid, and an end of a ground line 35 is electrically connected to the shield layer 33. The other end of the ground line 35 is electrically connected to a frame ground FG provided in the housing H2 of the power supply control unit 6, thus to be grounded (see FIG. 4 and FIG. 5). In addition, the sheath layer 34 constitutes the outer covering of the cables 30*a* and 30*b*, and is formed of, for example, an insulating material such as synthetic resins.

Figure 8:
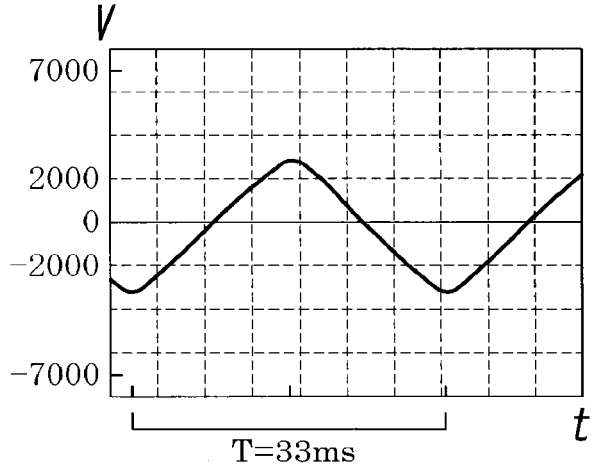
FIG. 8 is a graph showing an actual voltage waveform applied to a discharge electrode through a shielded cable, in a conventional ionizer.

Now, the cables 30*a* and 30*b* configured as above, in other words the shielded cable includes the insulating layer 32 provided between the electric wire 31 and the shield layer 33, which are conductors. Accordingly, a kind of capacitor (virtual capacitor) is formed between the conductor 31 and the shield layer 33, and an electrostatic capacitance C0, acting as a floating capacitance (parasitic capacitance), is generated in the cables 30*a* and 30*b*. In the case where, for example, the voltage outputted from the power supply control unit 6 (voltage V: 7000 V, period T: 33 ms as shown in FIG. 7) is transmitted through the cables 30*a* and 30*b* (C0: 500 pF) when the floating electrostatic capacitance C0 is present in the cable, a response delay is generated at a rising edge or falling edge of the pulse, and therefore the voltage waveform actually inputted to the electrode unit 2 (actually applied to the discharge electrodes 2*a* and 2*b*) is deformed as shown in FIG. 8.

In such a case, the ion generation efficiency is degraded since the amount of ion generated from the discharge electrode is proportional to an integral value of the voltage waveform actually applied to the electrode. In particular, when the polarity of the voltage is switched in a short period as in this embodiment, the positive and the negative voltage falls before completely rising, and therefore the ion generation efficiency is significantly degraded. Such a response delay becomes more prominent, the larger the floating electrostatic capacitance C0 is.

In the ionizer 1 according to this embodiment, therefore, an electronic device, specifically a capacitor 36 (electrostatic capacitance C1) is interposed halfway of the ground line 35 as shown in FIG. 1 and FIG. 2, with one electrode of the capacitor 36 electrically connected to the shield layer 33 and the other electrode of the capacitor 36 electrically connected to the ground FG. It is to be noted here that an electrostatic capacitance C1 of the capacitor 36 is smaller than the electrostatic capacitance C0 of the cable alone generated between the electric wire 31 and the shield layer 33 (i.e., floating electrostatic capacitance in the shielded cable).

By providing thus the capacitor 36 between the shield layer 33 of the cables 30*a* and 30*b* and the ground FG, at least two capacitors are connected in series between the electric wire 31 and the ground FG.

Under such a condition, a synthesized electrostatic capacitance Ct of the cable as a whole inclusive of the capacitor 36 (i.e., substantial electrostatic capacitance of the cable) can be obtained through the following equation (1):

$$Ct=C0\times C1/(C0+C1) \quad (1)$$

As result, the synthesized electrostatic capacitance Ct can be made smaller than the electrostatic capacitance C0 of the cable alone (i.e., floating electrostatic capacitance of the cables 30*a* and 30*b*). Moreover, in this embodiment the electrostatic capacitance C1 of the capacitor 36 is smaller than the floating electrostatic capacitance C0 of the cable, and therefore the synthesized electrostatic capacitance Ct can be suppressed to a level smaller than a half of the floating electrostatic capacitance C0.

In the case where the floating electrostatic capacitance C0 generated between the electric wire 31 and the shield layer 33 in each of the cables 30*a* and 30*b* has to be identified to determine the electrostatic capacitance C1 of the capacitor 36, the electrostatic capacitance per unit length of the cable may be obtained in advance by measurement or calculation, and the obtained value may be multiplied by the actual length of the cable, because the floating electrostatic capacitance C0 of the cable is proportional to the length thereof. Here, it is preferable that the electrostatic capacitance C1 is as small as possible, and it suffices that the electrostatic capacitance C1 is larger than zero.

Figure 3:
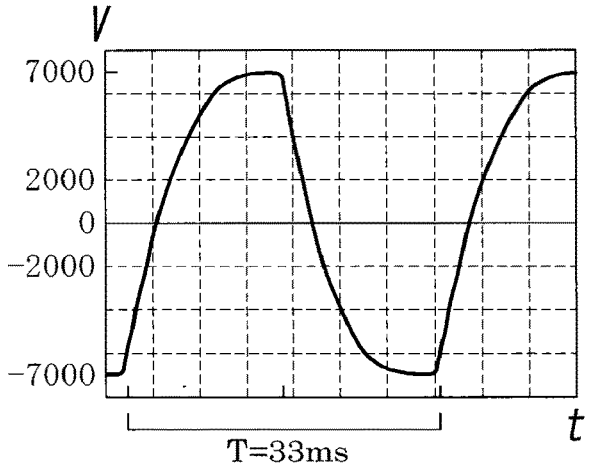
FIG. 3 is a graph showing an actual voltage waveform applied to a discharge electrode through the shielded cable, in the ionizer according to the present invention.

FIG. 3 represents the voltage waveform actually applied to the electrode unit 2 (i.e., actually applied to the discharge electrodes 2*a* and 2*b*), when the pulsating high voltage outputted from the power supply control unit 6 and illustrated in solid lines in FIG. 7 (approximately 7000 V) is transmitted at the period T(=33 ms) through the shielded cables 30*a* and 30*b* (C0: 500 pF) to which the capacitor 36 (C1: 10 pF) is connected, in the ionizer 1 according to this embodiment. In this case, according to the equation (1) the synthesized electrostatic capacitance Ct of the cable as a whole inclusive of the capacitor 36 is calculated as 9.8 pF.

Thus, providing the capacitor 36 between the shield layer 33 of the cable and the ground FG allows the voltage outputted from the power supply control unit 6 to be inputted to the electrode unit 2 maintaining a voltage waveform close to the initial one compared with the configuration without the capacitor 36 (see FIG. 8), thereby improving the ion generation efficiency from the discharge electrodes 2*a* and 2*b*. Such a configuration also eliminates the need to increase the voltage outputted from the power supply control unit 6, for example by increasing the size of the power source 4, in order to make up the degradation in ion generation efficiency originating from the floating electrostatic capacitance C0 in the cables 30*a* and 30*b*.

Here, it is not mandatory that the electrostatic capacitance C1 of the capacitor 36 is smaller than the floating electrostatic capacitance C0 of the cable as in this embodiment. This is because it is theoretically obvious according to the equation (1) that the synthesized electrostatic capacitance Ct becomes smaller than the floating electrostatic capacitance C0 merely by connecting the capacitor 36 between the shield layer 33 of the cables 30*a* and 30*b* and the ground FG. However, while the capacitor 36 having a larger electrostatic capacitance is larger in size and higher in cost, the advantage attained by adopting such a capacitor is reduced. Therefore, taking into account the cost versus performance of providing the capacitor 36, it is preferable to make the electrostatic capacitance C1 smaller than the floating electrostatic capacitance C0 of the cable, as in this embodiment.

Figure 4:
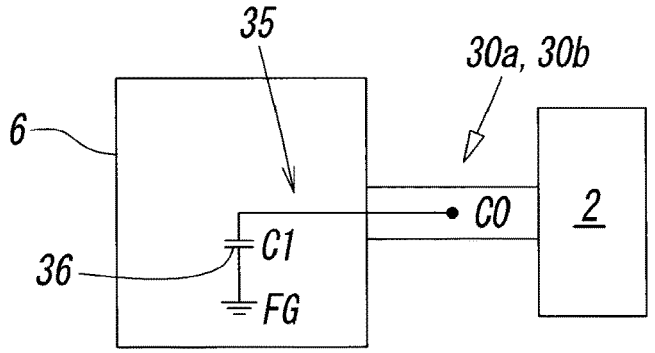
FIG. 4 is a schematic block diagram showing a connection example of a capacitor included in FIG. 1 and FIG. 2.
Figure 5:
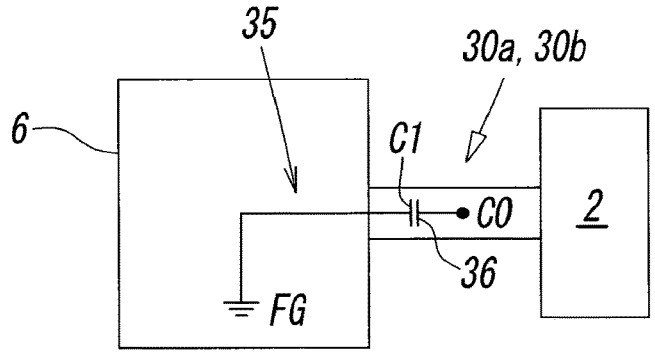
FIG. 5 is a schematic block diagram showing another connection example of the capacitor included in FIG. 1 and FIG. 2.

The capacitor 36, the electronic device provided halfway of the ground line 35, may be located in the power supply control unit 6 as shown in FIG. 4, and may be incorporated, in this case, in the boost rectifier circuit 7 for example. Alternatively, the capacitor 36 may be provided on the shielded cables 30*a* and 30*b* as shown in FIG. 5, in which case the capacitor 36 may be fixed on the outer circumferential surface of the sheath layer 34 or between the sheath layer 34 and the shield layer 33.

Figure 6:
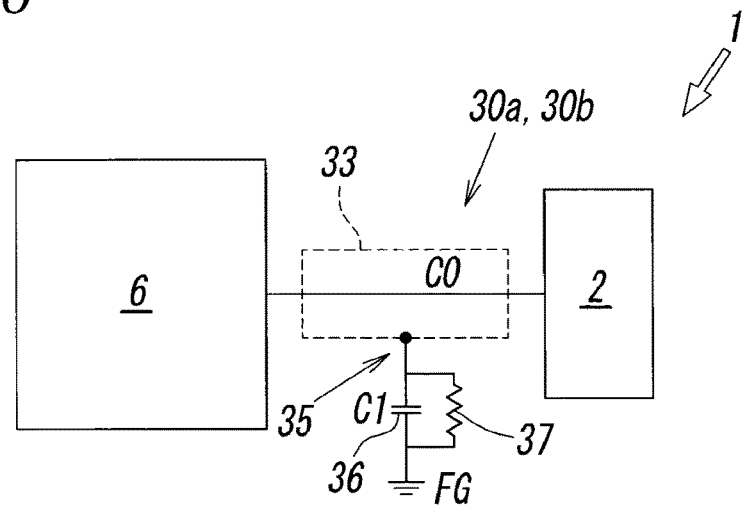
FIG. 6 is a schematic block diagram showing an essential part of an ionizer according to a second embodiment of the present invention.

Referring now to FIG. 6, a second embodiment of the present invention will be described. To avoid duplicated description, the same constituents as those of the first embodiment will be given the same numeral, and the description of such constituents, as well as the function and effect thereof, will not be repeated.

In the ionizer 1 according to this embodiment, a discharge resistance 37 is connected parallel to the capacitor 36, on the ground line 35 connecting between the shield layer 33 and the frame ground FG. Providing thus the discharge resistance 37 between the shield layer 33 of the shielded cable 30 and the frame ground FG allows the electric charge on the shielded cable 30 to be discharged through the resistance 37. Here, it is not mandatory that the discharge resistance 37 is provided on the same ground line 35 on which the capacitor 36 is provided as in this embodiment, and another ground line including the discharge resistance 37 may be additionally connected between the shield layer 33 and the frame ground FG.

Although the embodiments of the ionizer according to the present invention have been described in details as above, it is a matter of course that the present invention is not limited to the foregoing embodiments, and that various modifications may be made without departing from the scope of the present invention defined in the appended claims.

For example, although the first discharge electrode 2*a* and the second discharge electrode 2*b* are mounted in the single first housing H1 in the embodiments, the discharge electrodes may be mounted in separate housings. In addition, although the power source 4 is accommodated in the second housing H2 together with the high voltage generation circuit 5 in the embodiments, the power source 4 may be located in a third housing separated from the first and second housings H1 and H2, so as to be installed with a spacing from both of the electrode unit 2 and the power supply control unit 6. Further, although the ionizer according to the embodiments includes the first discharge electrode 2*a* and the second discharge electrode 2*b*, the ionizer may only include either of the first discharge electrode 2*a* and the second discharge electrode 2*b*.

The invention claimed is:

1. An ionizer comprising:

an electrode unit including a first discharge electrode and a second discharge electrode;

a power supply controller that outputs a pulsating high voltage to the first and second discharge electrodes; and a first cable and a second cable that electrically connect the first and second discharge electrodes and the power supply controller, wherein the electrode unit is formed by mounting the first and second discharge electrodes in a first housing separated from the power supply controller so as to be installed with a spacing from the power supply controller, wherein the first and second cables are shielded cables each including an electric wire formed of a conductor, an insulating layer formed of an insulating material surrounding the electric wire, and a shield layer formed of a conductor surrounding the insulating layer, and a capacitor is connected between the shield layer and ground, wherein the power supply controller includes:

a first step-up transformer, a second step-up transformer, a third step-up transformer, and a fourth step-up transformer that boost a oscillating voltage outputted from a oscillation power source;

a first positive electrode circuit and a second positive electrode circuit that convert the oscillating voltage boosted by the first and third step-up transformers into a DC high voltage of positive polarity;

a first negative electrode circuit and a second negative electrode circuit that convert the oscillating voltage boosted by the second and fourth step-up transformers into a DC high voltage of negative polarity;

a first switch and a third switch that individually turn on and off an electrical connection between the oscillation power source and the first and second positive electrode circuits respectively;

a second switch and a fourth switch that individually turn on and off an electrical connection between the oscillation power source and the first and second negative electrode circuits respectively;

a command circuit that outputs a command signal for turning on and off the first, second, third, and fourth switches; and a logic inverting circuit that inverts the command signal outputted from the command circuit to the second and third switches, and wherein the first positive electrode circuit and the first negative electrode circuit are connected to the first discharge electrode by the first cable, and the second positive electrode circuit and the second negative electrode circuit are connected to the second discharge electrode by the second cable.

2. The ionizer according to claim 1, wherein the capacitor has a smaller electrostatic capacitance than an electrostatic capacitance between the electric wire and the shield layer in the first and second cables.

3. The ionizer according to claim 1, wherein the capacitor is provided in the first and second cables.

4. The ionizer according to claim 1, wherein the power supply controller is accommodated in a second housing, and the capacitor is located in the second housing.

5. The ionizer according to claim 1, further comprising a discharge resistance for discharging an electric charge on the shield layer to the ground, connected parallel to the capacitor.

* * * * *